US011814713B2

(12) United States Patent
Wu et al.

(10) Patent No.: US 11,814,713 B2
(45) Date of Patent: Nov. 14, 2023

(54) RAPIDLY AGED, HIGH STRENGTH, HEAT TREATABLE ALUMINUM ALLOY PRODUCTS AND METHODS OF MAKING THE SAME

(71) Applicant: Novelis Inc., Atlanta, GA (US)

(72) Inventors: Cedric Wu, Marietta, GA (US); Rajeev G. Kamat, Marietta, GA (US); Yudie Yuan, Roswell, GA (US); David Leyvraz, Sierre (CH); Julie Richard, Sion (CH); Rahul Vilas Kulkarni, Marietta, GA (US); Peter Lloyd Redmond, Acworth, GA (US); Yi Wang, Los Angeles, CA (US); Rajasekhar Talla, Woodstock, GA (US); Rashmi Ranjan Mohanty, Roswell, GA (US); Tudor Piroteala, Acworth, GA (US)

(73) Assignee: Novelis Inc., Atlanta, GA (US)

( * ) Notice: Subject to any disclaimer, the term of this patent is extended or adjusted under 35 U.S.C. 154(b) by 173 days.

(21) Appl. No.: 16/679,515

(22) Filed: Nov. 11, 2019

(65) Prior Publication Data

US 2020/0149141 A1 May 14, 2020

Related U.S. Application Data

(60) Provisional application No. 62/758,840, filed on Nov. 12, 2018.

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC .... C22F 1/053; C22F 1/04; C22F 1/05; C22F 1/057; C22F 1/002; C22C 21/10; C22C 21/00; C22C 21/08; C22C 21/12
See application file for complete search history.

(56) References Cited

U.S. PATENT DOCUMENTS 3,791,880 A 2/1974 Hunsicker et al.
2012/0186706 A1 7/2012 Krajewski
(Continued)

FOREIGN PATENT DOCUMENTS

CN 102605303 7/2012
CN 102796974 11/2012
(Continued)

OTHER PUBLICATIONS

International Application No. PCT/US2019/060699, International Search Report and Written Opinion, dated Jun. 23, 2020, 26 pages.
(Continued)

*Primary Examiner* — Anthony M Liang
*Assistant Examiner* — Danny N Kang
(74) *Attorney, Agent, or Firm* — Kilpatrick Townsend & Stockton LLP

(57) ABSTRACT

Described herein are methods of processing heat treatable aluminum alloys using an accelerated aging step, along with aluminum alloy products prepared according to the methods. The methods of processing the heat treatable alloys described herein provide a more efficient method for producing aluminum alloy products having the desired strength and formability properties. For example, conventional methods of processing alloys can require 24 hours of aging. The methods described herein, however, substantially reduce the aging time, often requiring eight hours or less of aging time.

11 Claims, 2 Drawing Sheets

(56) References Cited

U.S. PATENT DOCUMENTS

| | | | | |
|---|---|---|---|---|
| 2013/0216790 | A1* | 8/2013 | Smeyers | C22C 21/10 428/174 |
| 2015/0101718 | A1 | 4/2015 | Harrison et al. | |
| 2015/0217813 | A1 | 8/2015 | Smeyers et al. | |
| 2016/0160332 | A1* | 6/2016 | Kamat | C21D 9/46 148/510 |
| 2017/0137920 | A1 | 5/2017 | Lin et al. | |
| 2017/0203353 | A1 | 7/2017 | Adam et al. | |
| 2018/0230583 | A1 | 8/2018 | Luckey, Jr. et al. | |

FOREIGN PATENT DOCUMENTS

| | | | |
|---|---|---|---|
| CN | 103614673 | | 3/2014 |
| CN | 104561861 | | 4/2015 |
| CN | 105121690 | | 12/2015 |
| CN | 106687230 | | 5/2017 |
| CN | 106756319 | | 5/2017 |
| CN | 107406925 | | 11/2017 |
| CN | 107686954 | | 2/2018 |
| CN | 108138269 | | 6/2018 |
| CN | 108220845 | | 6/2018 |
| DE | 69402496 | | 5/1997 |
| EP | 3265595 | | 1/2018 |
| JP | 06136493 | | 5/1994 |
| JP | 10168536 | | 6/1998 |
| JP | 2007289984 | | 11/2007 |
| JP | 2008525629 | A | 7/2008 |
| JP | 2011252212 | | 12/2011 |
| JP | 2011252212 | A * | 12/2011 |
| JP | 2016516899 | | 6/2016 |
| JP | 2017536485 | | 12/2017 |

OTHER PUBLICATIONS

Bartges , "Changes in Solid Solution Composition as a Function of Artificial Ageing Time for Aluminium Alloy 7075", Journal of Materials Science Letters, vol. 13, Jan. 1994, pp. 776-778.

Kumar et al., "Characterization of High Strength Al—Zn—Mg Alloy Sheet for Hot Stamping", Materials Science Forum, vols. 794-796, Jun. 2014, pp. 796-801.

Kumar et al., "Influence of Temper on the Performance of a High-Strength Al—Zn—Mg Alloy Sheet in the Warm Forming Processing Chain", Journal of Materials Processing Technology, vol. 231, Dec. 2015, pp. 189-198.

Maeno et al., "Hot Stamping of High-Strength Aluminium Alloy Aircraft Parts Using Quick Heating", Cirp Annals, Manufacturing Technology, vol. 66, Apr. 29, 2017, pp. 269-272.

PCT/US2019/060699 , "Invitation to Pay Additional Fees and, Where Applicable, Protest Fee", Apr. 23, 2020, 20 pages.

Chinese Application No. 201980074313.2 , Office Action, dated Dec. 2, 2021, 20 pages.

European Application No. 19836144.6 , Office Action, dated Jan. 5, 2022, 16 pages.

Miao et al., "Material Science for Non-Ferrous Metals", Northwestern Polytechnical University Press, Sep. 30, 2018. 3 pages.

Japanese Application No. 2021-525248 , Office Action, dated May 24, 2022, 14 pages.

Canadian Application No. 3,110,293 , "Office Action", dated Oct. 14, 2022, 3 pages.

European Application No. 19836144.6 , "Office Action", dated Sep. 16, 2022, 8 pages.

Korean Application No. 10-2021-7007202 , "Office Action", dated Aug. 11, 2022, 11 pages.

Chinese Application No. 201980074313.2, "Office Action", dated May 7, 2022, 12 pages.

Chinese Application No. 201980074313.2, "Office Action", dated Aug. 2, 2022, 18 pages.

Jian et al., "Production and Application of Aluminum Alloy Extrusion", Metallurgical Industry Press, Mar. 31, 2018, p. 90, pp. 96-102.

"Aluminum Handbook", General Incorporated Association, Japan Aluminium Association, Standard Committee, 7th Edition, Jan. 31, 2007, pp. 5-14.

Chinese Application No. 201980074313.2 , "Office Action", dated Nov. 4, 2022, 12 pages.

Japanese Application No. 2021-525248 , "Office Action", dated Nov. 22, 2022, 7 pages.

Yoshida et al., "Heat Treatment of Aluminum Alloys", The Japan Institute of Light Metals, vol. 45, No. 1, Jan. 1995, pp. 41-55.

Canadian Application No. 3,110,293 , Office Action, dated Jan. 26, 2022, 3 pages.

Conserva et al., "Age Hardening Behavior of TMT Processed Al—Zn—Mg—Cu Alloy", Materials Science and Engineering, vol. 11, No. 2, Feb. 1, 1973, pp. 103-112.

European Application No. 19836144.6 , Office Action, dated Mar. 25, 2022, 13 pages.

Harrison et al., "Hot Stamping of a B-Pillar Outer from High Strength Aluminum Sheet AA7075", SAE International Journal of Materials and Manufacturing, vol. 7, No. 3, Jun. 1, 2014, pp. 567-573.

Indian Application No. 202117017019 , "First Examination Report", dated Jan. 28, 2022, 6 pages.

Omer et al., "Process Parameters for Hot Stamping of AA7075 and D-7xxx to Achieve High Performance Aged Products", Journal of Materials Processing Technology, vol. 257, Jul. 1, 2018, pp. 170-179.

Korean Application No. 10-2021-7007202 , "Office Action", dated Feb. 15, 2023, 7 pages.

European Application No. 19836144.6 , "Office Action", dated Mar. 10, 2023, 7 pages.

Korean Application No. 10-2021-7007202 , "Notice of Decision to Grant", dated Jun. 29, 2023, 3 pages.

* cited by examiner

RAPIDLY AGED, HIGH STRENGTH, HEAT TREATABLE ALUMINUM ALLOY PRODUCTS AND METHODS OF MAKING THE SAME

CROSS-REFERENCE TO RELATED APPLICATION

The present application claims priority to and filing benefit of U.S. Patent Application No. 62/758,840, filed on Nov. 12, 2018, which is incorporated herein by reference in its entirety.

FIELD

The present disclosure relates to the field of aluminum alloys and products prepared therefrom, and more specifically to methods of processing aluminum alloy products.

BACKGROUND

Aluminum alloys with high strength are desirable for improved product performance in many applications, including automotive and other transportation (including, for example and without limitation, trucks, trailers, trains, aerospace, and marine) applications and electronics applications. Achieving such high strength aluminum alloy products often requires costly processing steps. For example, artificial aging procedures can require up to 24 hours or greater of treatment at elevated temperatures, amounting to a highly inefficient manufacturing process.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Described herein is a method of processing rolled aluminum alloy products, including solutionizing a rolled aluminum alloy product at a solutionizing temperature of at least about 400° C., quenching the rolled aluminum alloy product to produce a W temper rolled aluminum alloy product, naturally aging the W temper rolled aluminum alloy product to produce an intermediate aged rolled aluminum alloy product, and artificially aging the intermediate aged rolled aluminum alloy product for a period of up to about 8 hours. In some cases, the solutionizing temperature is from about 400° C. to about 500° C. In some non-limiting examples, the method further includes deforming the rolled aluminum alloy product at a temperature of from about 125° C. to about 500° C. In some aspects, quenching the rolled aluminum alloy product includes cooling the rolled aluminum alloy product at a rate of from about 5° C./second to about 1000° C./second and can be performed after solutionizing the rolled aluminum alloy product, after deforming the rolled aluminum alloy product, or both. In some examples, naturally aging the W temper rolled aluminum alloy product includes aging the W temper rolled aluminum alloy product at room temperature for up to about 12 months (e.g., up to about 6 months). In some aspects, artificially aging the intermediate aged rolled aluminum alloy product can include a single step aging procedure including heating the intermediate aged rolled aluminum alloy product to a temperature of at least about 140° C. and maintaining this temperature for up to about 8 hours. In some cases, artificially aging the intermediate aged rolled aluminum alloy product can include a multiple-step aging procedure including at least a first aging step and at least a second aging step. In some non-limiting examples, the first aging step can include heating the intermediate aged rolled aluminum alloy product to a first aging temperature of from about 90° C. to about 120° C. and maintaining the first aging temperature for about 0.5 hours to about 2 hours. In some non-limiting examples, the second aging step can include heating the intermediate aged rolled aluminum alloy product to a second aging temperature of from about 140° C. to about 220° C. and maintaining the second aging temperature for about 0.5 hours to about 7.5 hours.

In certain embodiments, the first aging step comprises heating the intermediate aged rolled aluminum alloy product to a first aging temperature of from about 50° C. to about 90° C. and maintaining the first aging temperature for up to about 1 hour. Accordingly, the second aging step comprises heating the intermediate aged rolled aluminum alloy product to a second aging temperature of from about 160° C. to about 200° C. and maintaining the second aging temperature for up to about 1 hour.

In certain further embodiments, the method comprises heating the intermediate aged rolled aluminum alloy product to a first aging temperature of from about 90° C. to about 135° C. and maintaining the first aging temperature for a period of time; and the second aging step comprises heating the intermediate aged rolled aluminum alloy product to a second aging temperature of from about 140° C. to about 220° C. and maintaining the second aging temperature for a period of time, wherein a total aging time of the first aging step and the second aging step is greater than 5 hours.

In some aspects, the rolled aluminum alloy product can be a heat treatable rolled aluminum alloy product and optionally can be prepared from a monolithic alloy or from a clad rolled aluminum alloy product having a core layer and at least one cladding layer.

Also described herein is a method of processing a rolled aluminum alloy product including deforming a rolled aluminum alloy product at a temperature of from about 125° C. to about 500° C., quenching the rolled aluminum alloy product to produce a W temper rolled aluminum alloy product, naturally aging the W temper rolled aluminum alloy product to produce an intermediate aged rolled aluminum alloy product, and artificially aging the intermediate aged rolled aluminum alloy product for a period of up to about 8 hours. In some cases, the quenching includes cooling the rolled aluminum alloy product at a rate of from about 5° C./second to about 1000° C./second after deforming the rolled aluminum alloy product. In some non-limiting examples, naturally aging the W temper rolled aluminum alloy product includes aging the W temper rolled aluminum alloy product for up to about 12 months (e.g., up to about 6 months). Optionally, artificially aging the intermediate aged rolled aluminum alloy product can include a single step aging procedure including heating the intermediate aged rolled aluminum alloy product to a temperature of at least about 140° C. and maintaining this temperature for up to about 8 hours. Optionally, artificially aging the intermediate aged rolled aluminum alloy product can include a multiple-step aging procedure, including at least a first aging step and at least a second aging step. In some non-limiting examples, the first aging step can include heating the intermediate aged rolled aluminum alloy product to a first aging temperature of from about 90° C. to about 120° C. and maintaining the first aging temperature for about 0.5 hours to about 2 hours. The second aging step can include heating the intermediate aged rolled aluminum alloy product to a second aging temperature of from about 140° C. to about 220° C. and maintaining the second aging temperature for about 0.5 hours to about 7.5 hours.

In certain embodiments, the first aging step comprises heating the intermediate aged rolled aluminum alloy product to a first aging temperature of from about 50° C. to about 90° C. and maintaining the first aging temperature for up to about 1 hour. Accordingly, the second aging step comprises heating the intermediate aged rolled aluminum alloy product to a second aging temperature of from about 160° C. to about 200° C. and maintaining the second aging temperature for up to about 1 hour.

In certain further embodiments, the method comprises heating the intermediate aged rolled aluminum alloy product to a first aging temperature of from about 90° C. to about 135° C. and maintaining the first aging temperature for a period of time; and the second aging step comprises heating the intermediate aged rolled aluminum alloy product to a second aging temperature of from about 140° C. to about 220° C. and maintaining the second aging temperature for a period of time, wherein a total aging time of the first aging step and the second aging step is greater than 5 hours.

In some non-limiting examples, the rolled aluminum alloy product can be a heat treatable rolled aluminum alloy product that can optionally be prepared from a monolithic alloy or from a clad rolled aluminum alloy product having a core layer and at least one cladding layer.

Also disclosed herein is a product prepared according to the methods described herein. In some non-limiting examples, the product is in a T7 temper. In some aspects, an equivalent circular diameter of intergranular precipitates can be up to about 10 nanometers (e.g., from about 5 nanometers to about 10 nanometers). In some cases, the product can exhibit an electrical conductivity of up to about 40% International Annealed Copper Standard (% IACS) (e.g., from about 30% IACS to about 40% IACS), a yield strength of at least about 450 MPa, a uniform elongation of at least about 6%, and/or a three-point bend beta angle (β-angle) of at least 132.5°.

In some non-limiting examples, the product described herein can be formed into an automotive body part (e.g., a bumper, a side beam, a roof beam, a cross beam, a pillar reinforcement, an inner panel, an outer panel, a side panel, an inner hood, an outer hood, or a trunk lid panel), an aerospace body part, or an electronic device housing.

In certain aspects, the product exhibits a three-point bend β-angle sufficient for self-piercing riveting, and an electrical conductivity sufficient to indicate resistance to stress corrosion cracking.

Other objects and advantages will be apparent from the following detailed description of non-limiting examples and the figures.

DETAILED DESCRIPTION

Figure 1:
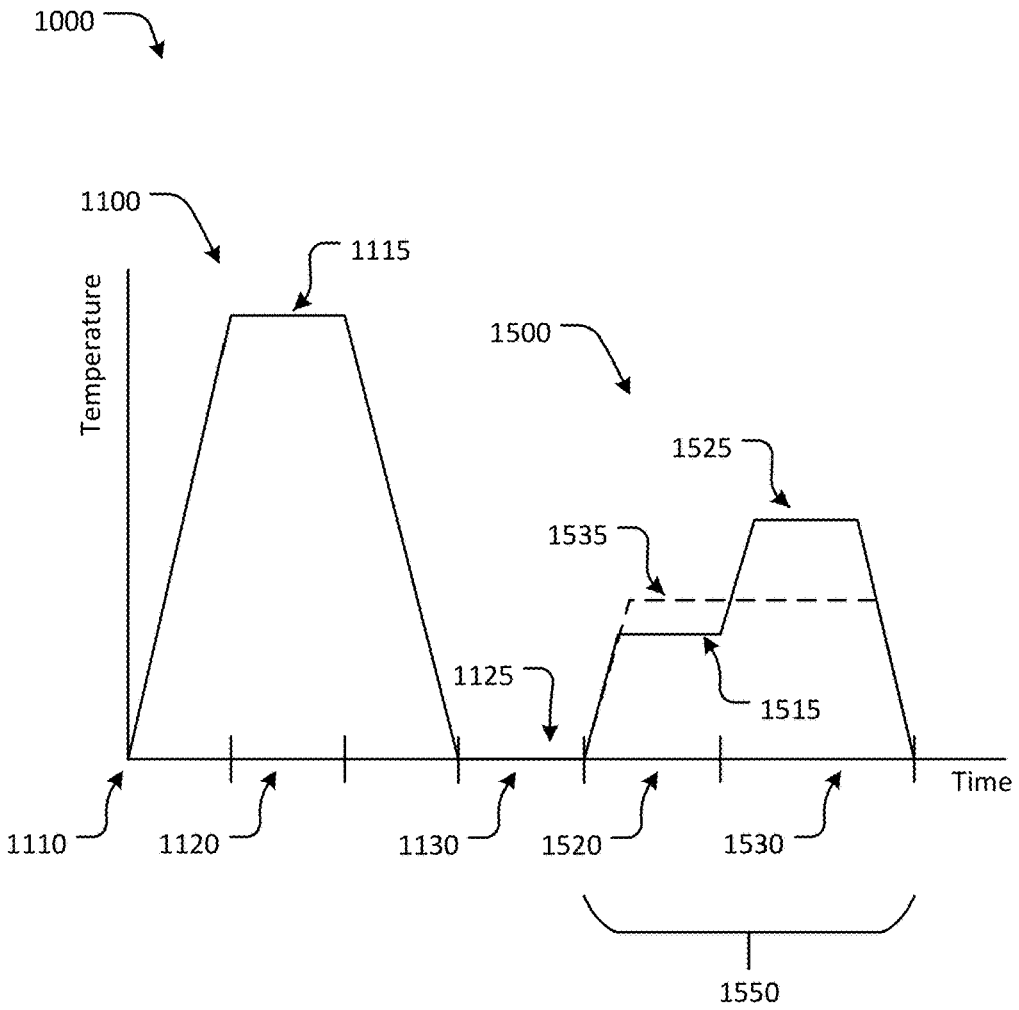
FIG. 1 is a schematic depicting thermal histories of a heat treatable rolled aluminum alloy product prepared and processed according to the methods described herein.

Described herein are methods of processing heat treatable aluminum alloys using an accelerated aging process, along with aluminum alloy products prepared according to the methods. The methods of processing the heat treatable aluminum alloys described herein provide a more efficient method for producing rolled aluminum alloy products having desirable strength and formability properties. For example, conventional methods of processing alloys can require 24 hours or greater of aging at elevated temperatures. The methods described herein, however, substantially reduce the aging time, often requiring eight hours or less of aging time. The resulting rolled aluminum alloy products, when subjected to subsequent thermal treatment (e.g., paint baking or post-forming heat treatment), surprisingly exhibit strengths comparable to or higher than those prepared according to conventional methods with longer aging times.

Definitions and Descriptions

The terms "invention," "the invention," "this invention," and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

As used herein, a plate generally has a thickness of greater than about 15 mm. For example, a plate may refer to a rolled aluminum alloy product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally refers to a rolled aluminum alloy product having a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to a rolled aluminum alloy product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

Reference is made in this application to alloy condition or temper. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8× condition or temper refers to an aluminum alloy solution heat treated, cold worked, and artificially aged. A T9 condition or temper refers to an aluminum alloy solution heat treated, artificially aged, and cold worked. A W condition or temper refers to an aluminum alloy solution heat treated and quenched and before age hardening.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

In some cases, the aluminum alloys are described in terms of their elemental composition in weight percentage (wt. %) based on the total weight of the alloy. In certain examples of each alloy, the remainder is aluminum, with a maximum wt. % of 0.15% for the sum of the impurities.

Preparing and Processing Methods

The methods described herein include subjecting a rolled aluminum alloy product to a heat treatment step (e.g., a solutionizing step and/or a deforming step at an elevated temperature), followed by quenching and an accelerated aging process. In some non-limiting examples, the rolled aluminum alloy product can be solutionized to dissolve the soluble phases, which occurs when the rolled aluminum alloy product is maintained at a sufficient temperature for a sufficient time to achieve a nearly homogeneous solid solution and then quenched to achieve supersaturation. In some other non-limiting examples, the rolled aluminum alloy products can be deformed at an elevated temperature to provide a shaped aluminum alloy product, and then quenched to arrest any dislocation motion resulting from the deforming step. The heat treating and quenching steps as described above (e.g., the solutionizing and quenching steps, and/or the deforming performed at an elevated temperature and quenching steps) allow for the accelerated aging process as described herein.

Suitable rolled aluminum alloy products for use in the methods described herein include heat treatable aluminum alloy products, for example, 2xxx series aluminum alloy products, 6xxx series aluminum alloy products, and/or 7xxx series aluminum alloy products. In some examples, the aluminum alloy products can include a 2xxx series aluminum alloy, such as, for example, AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Optionally, the rolled aluminum alloy product can include a 6xxx series aluminum alloy such as, for example, AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Optionally, the rolled aluminum alloy product can include a 7xxx series aluminum alloy such as, for example, AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7012, AA7014, AA7016, AA7116, AA7122, AA7023, AA7026, AA7029, AA7129, AA7229, AA7032, AA7034, AA7036, AA7136, AA7037, AA7040, AA7140, AA7041, AA7049, AA7049A, AA7149, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, or AA7099.

In some examples, the rolled aluminum alloy products for use in the methods described herein are prepared from monolithic alloys. In other examples, the rolled aluminum alloy products for use in the methods described herein are clad rolled aluminum alloy products, having a core layer and one or two cladding layers. In some cases, the core layer and/or the cladding layer(s) can be a 7xxx series aluminum alloy. In some cases, the core layer has a different composition from one or both of the cladding layers. In some non-limiting examples, the clad rolled aluminum alloy products can include a 6xxx series aluminum alloy core layer with a 7xxx series aluminum alloy cladding layer, a 2xxx series aluminum alloy core layer with a 6xxx series aluminum alloy cladding layer, or a 2xxx series aluminum alloy core layer with a 7xxx series aluminum alloy cladding layer.

The methods described herein can be carried out on rolled aluminum alloy products prepared by casting an aluminum alloy using any suitable casting process. For example, an aluminum alloy as described herein may be cast using a continuous casting (CC) process that may include, but is not limited to, the use of twin belt casters, twin roll casters, or block casters. In some examples, the casting process is performed by a CC process to form a cast product such as a billet, slab, strip, or the like. In some examples, the casting process is performed by a direct chill (DC) casting process to form a cast product such as an ingot.

The cast product can then be subjected to further processing steps. In one non-limiting example, the processing method can include one or more of the following steps: homogenizing, hot rolling, cold rolling, and/or annealing to produce a rolled aluminum alloy product. Optionally, the gauge of the rolled aluminum alloy product for use in the methods described herein can be about 15 mm or less (e.g., about 14 mm or less, about 13 mm or less, about 12 mm or less, about 11 mm or less, about 10 mm or less, about 9 mm or less, about 8 mm or less, about 7 mm or less, about 6 mm or less, about 5 mm or less, about 4 mm or less, about 3 mm or less, about 2 mm or less, about 1 mm or less, about 0.9 mm or less, about 0.8 mm or less, about 0.7 mm or less, about 0.6 mm or less, about 0.5 mm or less, about 0.4 mm or less, about 0.3 mm or less, about 0.2 mm or less, or about 0.1 mm or less). The temper of the as-rolled aluminum alloy product is referred to as F temper.

Solutionizing and Quenching

The rolled aluminum alloy product in an F temper can be subjected to a heat treatment step, such as a solutionizing (i.e., solution heat treatment) step. The solutionizing step can include heating the rolled aluminum alloy product from room temperature to a solutionizing temperature of at least about 400° C. In some cases, the solutionizing temperature can be from about 400° C. to about 500° C. (e.g., from about 410° C. to about 490° C., from about 420° C. to about 480° C., from about 430° C. to about 470° C., or from about 440° C. to about 460° C.). For example, the solutionizing temperature can be about 400° C., about 405° C., about 410° C., about 415° C., about 420° C., about 425° C., about 430° C., about 435° C., about 440° C., about 445° C., about 450° C., about 455° C., about 460° C., about 465° C., about 470° C., about 475° C., about 480° C., about 485° C., about 490° C., about 495° C., or about 500° C.

The rolled aluminum alloy product can be maintained at the solutionizing temperature (i.e., soaked at the solutionizing temperature) for a desired period of time. In certain aspects, the rolled aluminum alloy product is allowed to soak for at least about 30 seconds (e.g., from about 60 seconds to about 120 minutes, inclusively). For example, the rolled aluminum alloy product can be soaked at the solutionizing temperature for about 30 seconds, about 35 seconds, about 40 seconds, about 45 seconds, about 50 seconds, about 55 seconds, about 60 seconds, about 65 seconds, about 70 seconds, about 75 seconds, about 80 seconds, about 85 seconds, about 90 seconds, about 95 seconds, about 100 seconds, about 105 seconds, about 110 seconds, about 115 seconds, about 120 seconds, about 125 seconds, about 130 seconds, about 135 seconds, about 140 seconds, about 145 seconds, about 150 seconds, about 5 minutes, about 10 minutes, about 15 minutes, about 20 minutes, about 25 minutes, about 30 minutes, about 35 minutes, about 40 minutes, about 45 minutes, about 50 minutes, about 55 minutes, about 60 minutes, about 65 minutes, about 70 minutes, about 75 minutes, about 80 minutes, about 85 minutes, about 90 minutes, about 95 minutes, about 100 minutes, about 105 minutes, about 110 minutes, about 115 minutes, or about 120 minutes, or anywhere in between.

The solutionizing step can be following by a quenching step. The term "quenching," as used herein, refers to rapidly reducing a temperature of an aluminum alloy product. In this case, the quenching step following the solutionizing step includes reducing the temperature of a rolled aluminum alloy product that has been solutionized as described above. The quenching can be performed using a liquid (e.g., water) and/or gas or another selected quench medium. In some examples, the quenching can be performed by pressing the rolled aluminum alloy product between two chilled plates. In certain aspects, the rolled aluminum alloy product can be quenched using water at a temperature between about 40° C. and about 75° C. In certain aspects, the rolled aluminum alloy product is quenched using forced air.

The quench rate can be from about 5° C./s to about 1000° C./s. The quench rate and other conditions can be selected based on a variety of factors, such as a desired combination of properties to be exhibited by the rolled aluminum alloy product and/or the gauge of the rolled aluminum alloy product. In some cases, the quench rate can be from about 5° C./s to about 975° C./s, from about 10° C./s to about 950° C./s, from about 25° C./s to about 800° C./s, from about 50° C./s to about 700° C./s, from about 75° C./s to about 600° C./s, from about 100° C./s to about 500° C./s, from about 200° C./s to about 400° C./s, or anywhere in between. For example, the quench rate can be about 5° C./s, about 10° C./s, about 15° C./s, about 20° C./s, about 25° C./s, about 30° C./s, about 35° C./s, about 40° C./s, about 45° C./s, about 50° C./s, about 55° C./s, about 60° C./s, about 65° C./s, about 70° C./s, about 75° C./s, about 80° C./s, about 85° C./s, about 90° C./s, about 95° C./s, about 100° C./s, about 200° C./s, about 300° C./s, about 400° C./s, about 500° C./s, about 600° C./s, about 700° C./s, about 800° C./s, about 900° C./s, or about 1000° C./s.

Deforming and Quenching

The methods described herein can include at least one deforming step. The term "deforming," as used herein, may include cutting, stamping, pressing, press-forming, drawing, shaping, straining, or other processes that can create two- or three-dimensional shapes as known to one of ordinary skill in the art. For example, in the stamping or pressing step, a rolled aluminum alloy product is deformed by pressing it between two dies of complementary shape. The deforming step can be performed either on a rolled aluminum alloy product after the quenching step or on a rolled aluminum alloy product at an elevated temperature.

In some examples, the deforming step can be performed on a rolled aluminum alloy product at an elevated temperature (e.g., greater than room temperature to about 500° C.). For example, the deforming step can be performed on a rolled aluminum alloy product at a temperature of from about 40° C. to about 500° C., from about 100° C. to about 440° C., or from about 150° C. to about 400° C. In some cases, the deforming step can be a warm forming process. As used herein, warm forming refers to a deforming step that is performed at a temperature greater than room temperature up to about 250° C. In some cases, the warm forming can be performed at a temperature of from about 40° C. to about 250° C., from about 50° C. to about 240° C., from about 75° C. to about 200° C., or from about 100° C. to about 175° C. For example, the warm forming can be performed at a temperature of about 40° C., about 50° C., about 60° C., about 70° C., about 80° C., about 90° C., about 100° C., about 110° C., about 120° C., about 130° C., about 140° C., about 150° C., about 160° C., about 170° C., about 180° C., about 190° C., about 200° C., about 210° C., about 220° C., about 230° C., about 240° C., or about 250° C.

In some cases, the deforming step can be a hot forming process. As used herein, hot forming refers to a deforming step that is performed at a temperature from about 255° C. to about 500° C. In some cases, the hot forming can be performed at a temperature of from about 260° C. to about 500° C., from about 275° C. to about 475° C., from about 300° C. to about 450° C., or from about 325° C. to about 400° C. For example, the hot forming can be performed at a temperature of about 255° C., about 260° C., about 265° C., about 270° C., about 275° C., about 280° C., about 285° C., about 290° C., about 295° C., about 300° C., about 305° C., about 310° C., about 315° C., about 320° C., about 325° C., about 330° C., about 335° C., about 340° C., about 345° C., about 350° C., about 355° C., about 360° C., about 365° C., about 370° C., about 375° C., about 380° C., about 385° C., about 390° C., about 395° C., about 400° C., about 405° C., about 410° C., about 415° C., about 420° C., about 425° C., about 430° C., about 435° C., about 440° C., about 445° C., about 450° C., about 455° C., about 460° C., about 465° C., about 470° C., about 475° C., about 480° C., about 485° C., about 490° C., about 495° C., or about 500° C. In some cases, the deforming step can be followed by a quenching step, as described above.

In some cases, the deforming step can be performed on a rolled aluminum alloy product at a temperature below 125° C. (e.g., from room temperature to a temperature lower than 125° C.). For example, the deforming step can be performed on a rolled aluminum alloy product at a temperature of from about 15° C. to about 120° C., from about 30° C. to about 110° C., or from about 50° C. to about 90° C. Optionally, the warm forming can be performed at a temperature of about 20° C., about 30° C., about 40° C., about 50° C., about 60° C., about 70° C., about 80° C., about 90° C., about 100° C., about 110° C., or about 120° C.

Accelerated Aging

The rolled aluminum alloy products prepared by the heat treating and quenching steps described above are in a W temper (i.e., a designation describing an aluminum alloy after heat treatment and quenching and before age-hardening). In the methods described herein, the W temper rolled aluminum alloy products can undergo an accelerated aging process that can result in the age-hardening of the rolled aluminum alloy products. In some aspects, age-hardening is performed to achieve precipitation of solute atoms of alloying elements either at room temperature (natural aging) and/or at an elevated temperature (artificial aging or precipitation heat treatment). In some cases, the accelerated aging process described herein includes a natural aging process along with an artificial aging process in which the W temper rolled aluminum alloy products are heated at an elevated temperature ranging from 90° C. to 220° C. for up to about 8 hours. In some cases, a natural aging step is not performed. The rolled aluminum alloy products processed according to the accelerated aging process described herein achieve an improvement in strength and hardness properties that is comparable to or greater than that achieved by the costly and time consuming conventional, artificial aging methods (which require substantially longer aging times, e.g., at least 24 hours).

In some non-limiting examples, the rolled aluminum alloy products in W temper are naturally aged for a period of time (e.g., up to about 12 months, up to about 9 months, up to about 6 months, up to about 3 months, up to about 1 month, or up to about 2 weeks). In some cases, the natural aging period can be from about 1 day to about 10 months, from about 3 months to about 8 months, or from about 4 months to about 6 months. For example, the rolled aluminum alloy products can be naturally aged for about 1 day, about 2 days, about 3 days, about 4 days, about 5 days, about 6 days, about 7 days, about 2 weeks, about 3 weeks, about 1 month, about 2 months, about 3 months, about 4 months, about 5 months, about 6 months, about 7 months, about 8 months, about 9 months, about 10 months, about 11 months, about 12 months, or anywhere in between. The natural aging step results in intermediate aged rolled aluminum alloy products.

After natural aging, the intermediate aged rolled aluminum alloy products can be subjected to an artificial aging process. The artificial aging process can be performed for a period of up to about 8 hours (e.g., up to about 7 hours, up to about 6 hours, up to about 5 hours, up to about 4 hours, up to about 3 hours, up to about 2 hours, up to about 1 hour, or up to about 30 minutes). In some cases, the artificial aging process is a single step aging procedure. In the single step aging procedure, the intermediate aged rolled aluminum alloy product can be heated to a temperature of at least about 140° C. (e.g., from about 140° C. to about 300° C.). For example, the intermediate aged rolled aluminum alloy product can be heated to a temperature of about 140° C., about 150° C., about 160° C., about 170° C., about 180° C., about 190° C., about 200° C., about 210° C., about 220° C., about 230° C., about 240° C., about 250° C., about 260° C., about 270° C., about 280° C., about 290° C., or about 300° C. The intermediate aged rolled aluminum alloy product can be maintained at a temperature of at least about 140° C. for up to about 8 hours (e.g., from 10 minutes to 8 hours, from 20 minutes to 7 hours, from 30 minutes to 6 hours, from 1 hour to 5 hours, or from 2 hours to 4 hours).

In some cases, the artificial aging process is a multiple-step aging procedure, including at least a first aging step and at least a second aging step. The first aging step includes heating the intermediate aged rolled aluminum alloy product to a first aging temperature and maintaining the intermediate aged rolled aluminum alloy product at the first aging temperature for a period of time.

In some cases, the first aging temperature can be from about 90° C. to about 120° C. For example, the temperature for the first aging step can be about 90° C., about 95° C., about 100° C., about 105° C., about 110° C., about 115° C., or about 120° C. The intermediate aged rolled aluminum alloy product can be maintained at the first aging temperature for up to about 2 hours (e.g., from about 30 minutes to about 2 hours). For example, the intermediate aged rolled aluminum alloy product can be maintained at the first aging temperature for about 10 minutes, about 20 minutes, about 30 minutes, about 40 minutes, about 50 minutes, about 1 hour, or about 2 hours.

Following the first aging step, the temperature of the intermediate aged rolled aluminum alloy product can be increased to a second aging temperature and maintained at the second aging temperature for a period of time. The second aging temperature can be from about 140° C. to about 220° C. For example, the temperature for the second aging step can be about 140° C., about 145° C., about 150° C., about 155° C., about 160° C., about 165° C., about 170° C., about 175° C., about 180° C., about 185° C., about 190° C., about 195° C., about 200° C., about 205° C., about 210° C., about 215° C., or about 220° C. The intermediate aged rolled aluminum alloy product can be maintained at the second aging temperature for up to about 7.5 hours (e.g., from about 30 minutes to about 7.5 hours). For example, the intermediate aged rolled aluminum alloy product can be maintained at the first aging temperature for about 1 minute, about 5 minutes, about 10 minutes, about 15 minutes, about 20 minutes, about 25 minutes, about 30 minutes, about 35 minutes, about 40 minutes, about 45 minutes, about 50 minutes, about 55 minutes, about 1 hour, about 2 hours, about 3 hours, about 4 hours, about 5 hours, about 6 hours, about 7 hours, or about 7.5 hours.

In another embodiment, the artificial aging process is a multiple-step aging procedure, including at least a first aging step and at least a second aging step, wherein the total aging time (e.g., the combined total time of the first aging step and the second aging step) is greater than 5 hours, as detailed below. The first aging step includes heating the intermediate aged rolled aluminum alloy product to a first aging temperature and maintaining the intermediate aged rolled aluminum alloy product at the first aging temperature for a period of time. The first aging temperature can be from about 90° C. to about 135° C. For example, the temperature for the first aging step can be about 90° C., about 95° C., about 100° C., about 105° C., about 110° C., about 115° C., about 120° C., about 125° C., about 130° C., or about 135° C. The intermediate aged rolled aluminum alloy product can be maintained at the first aging temperature for up to about 2 hours (e.g., from about 30 minutes to about 2 hours). For example, the intermediate aged rolled aluminum alloy product can be maintained at the first aging temperature for about 10 minutes, about 20 minutes, about 30 minutes, about 40 minutes, about 50 minutes, about 1 hour, or about 2 hours.

Following the first aging step, the temperature of the intermediate aged rolled aluminum alloy product can be increased to a second aging temperature and maintained at the second aging temperature for a period of time. The second aging temperature can be from about 140° C. to about 220° C. For example, the temperature for the second aging step can be about 140° C., about 145° C., about 150° C., about 155° C., about 160° C., about 165° C., about 170° C., about 175° C., about 180° C., about 185° C., about 190° C., about 195° C., about 200° C., about 205° C., about 210° C., about 215° C., or about 220° C. The intermediate aged rolled aluminum alloy product can be maintained at the second aging temperature for up to about 7.5 hours (e.g., from about 30 minutes to about 7.5 hours). For example, the intermediate aged rolled aluminum alloy product can be maintained at the first aging temperature for about 1 minute, about 5 minutes, about 10 minutes, about 15 minutes, about 20 minutes, about 25 minutes, about 30 minutes, about 35 minutes, about 40 minutes, about 45 minutes, about 50 minutes, about 55 minutes, about 1 hour, about 2 hours, about 3 hours, about 4 hours, about 5 hours, about 6 hours, about 7 hours, or about 7.5 hours.

As noted above, in some embodiments, the total aging time for the accelerated aging process is greater than 5 hours. In other words, the respective times for the first aging step, the second aging step, and any additional aging steps are selected such that the combined aging time exceeds 5 hours. In some cases, the total aging time is greater than 5 hours, about 5.5 hours or greater, about 6 hours or greater, about 6.5 hours or greater, about 7 hours or greater, about 7.5 hours or greater, about 8 hours or greater, about 8.5 hours or greater, or about 9 hours or greater.

In a further embodiment, the artificial aging process is a multiple-step aging procedure, including at least a first aging step performed at a temperature from about 50° C. to about 90° C. and at least a second aging step performed at a temperature from about 160° C. to about 200° C. The first aging step includes heating the intermediate aged rolled aluminum alloy product to a first aging temperature and maintaining the intermediate aged rolled aluminum alloy product at the first aging temperature for a period of time. The first aging temperature can be from about 50° C. to about 90° C. For example, the temperature for the first aging step can be about 50° C., about 55° C., about 60° C., about 65° C., about 70° C., about 75° C., about 80° C., about 85° C., or about 90° C. The intermediate aged rolled aluminum alloy product can be maintained at the first aging temperature for up to about 60 minutes (e.g., from about 1 minute to about 1 hour). For example, the intermediate aged rolled aluminum alloy product can be maintained at the first aging temperature for about 1 minute, about 10 minutes, about 15 minutes, about 20 minutes, about 25 minutes, about 30 minutes, about 35 minutes, about 40 minutes, about 45 minutes, about 50 minutes, about 55 minutes, or about 1 hour.

Additionally, in the further embodiment, the temperature of the intermediate aged rolled aluminum alloy product can be increased to a second aging temperature and maintained at the second aging temperature for a period of time. The second aging temperature can be from about 160° C. to about 200° C. For example, the temperature for the second aging step can be about 160° C., about 165° C., about 170° C., about 175° C., about 180° C., about 185° C., about 190° C., about 195° C., or about 200° C. The intermediate aged rolled aluminum alloy product can be maintained at the second aging temperature for up to about 1 hour (e.g., from about 1 minute to about 1 hour). For example, the intermediate aged rolled aluminum alloy product can be maintained at the first aging temperature for about 1 minute, about 10 minutes, about 15 minutes, about 20 minutes, about 25 minutes, about 30 minutes, about 35 minutes, about 40 minutes, about 45 minutes, about 50 minutes, about 55 minutes, or about 1 hour.

As noted above, in some cases, a natural aging step does not occur. In these examples, the artificial aging procedures as described above can be performed on the W temper rolled aluminum alloy product.

After the accelerated aging process is complete, the heat treatable rolled aluminum alloy product is in a T7 temper. Exemplary accelerated aging processes are provided in the Examples section herein.

In some cases, a method of processing a rolled aluminum alloy product can include a step of deforming a rolled aluminum alloy product at a temperature below 125° C. Optionally, the resulting product can be naturally aged. The product can then be artificially aged as described herein for a period of up to about 8 hours.

In other cases, a method of processing a rolled aluminum alloy product can include a step of deforming a rolled aluminum alloy product at a temperature of from about 125° C. to about 300° C. Optionally, the resulting product can be naturally aged. The product can then be artificially aged as described herein for a period of up to about 8 hours.

In some cases, a method of processing a rolled aluminum alloy product can include a step of deforming a rolled aluminum alloy product at a temperature of from about 300° C. to about 500° C. The resulting product can then be quenched to produce a W temper rolled aluminum alloy product. Optionally, the W temper rolled aluminum alloy product can be naturally aged to produce an intermediate aged rolled aluminum alloy product. The intermediate aged rolled aluminum alloy product can then be artificially aged as described herein for a period of up to about 8 hours.

In certain aspects, a method of processing a rolled aluminum alloy product can include a step of post-processing heat treatment (e.g., post-forming heat treat and/or paint baking). For example, the rolled aluminum alloy product can be heated to a paint bake temperature and maintained at that temperature (also referred to as paint baked) for a period of time. In some cases, the paint bake temperature can be from about 80° C. to about 125° C. For example, the paint bake temperature can be about 80° C., about 85° C., about 90° C., about 95° C., about 100° C., about 105° C., about 110° C., about 115° C., about 120° C., or about 125° C. In some examples, the rolled aluminum alloy product can be paint baked for up to about 45 minutes. For example, the paint bake temperature can be maintained for about 30 seconds, about 1 minute, about 10 minutes, about 15 minutes, about 20 minutes, about 25 minutes, about 30 minutes, about 35 minutes, about 40 minutes, or about 45 minutes.

A schematic depicting an exemplary thermal history 1000 is shown in FIG. 1. In some non-limiting examples, a rolled aluminum alloy product is first subjected to a solutionizing and quenching, and/or a hot forming and quenching step 1100. At the beginning 1110 of the solutionizing and quenching, and/or a hot forming and quenching step 1100 the rolled aluminum alloy product is in an F temper. The rolled aluminum alloy product can be heated to the solutionizing and/or hot forming temperature 1115 of from about 400° C. to about 500° C. and maintained at this temperature for a period of time 1120 of up to about 2 hours. The rolled aluminum alloy product can be quenched to a temperature of about room temperature 1125. The resulting W temper rolled aluminum alloy product can be naturally aged for a period of time 1130 of up to about 1 year to provide an intermediate aged rolled aluminum alloy product. Following natural aging, the intermediate aged rolled aluminum alloy products can be subjected to an artificial aging process 1500. In some non-limiting examples, the artificial aging process 1500 is a multiple-step aging procedure, including heating to a first aging temperature 1515 of from about 90° C. to about 135° C. and maintaining the first aging temperature 1515 for a first period of time 1520 of from about 0.5 hours to about 2 hours, and subsequently heating to a second aging temperature 1525 of from about 140° C. to about 220° C. and maintaining the second aging temperature 1525 for a second period of time 1530 of from about 0.5 hours to about 7.5 hours. Optionally, the artificial aging process 1500 can be a single step process, wherein the intermediate aged rolled aluminum alloy product can be heated to a temperature 1535 of at least about 140° C. and maintained at the temperature 1535 for a period of time 1550 of up to about 8 hours.

Properties

The products resulting from the methods described herein are in a T7 temper. Achieving the T7 temper can be attributed to solute precipitation at grain boundaries, in which solute precipitates can have an equivalent circular diameter (ECD, i.e., a diameter observed through microscopy techniques, wherein the precipitates can appear circular in the field of view regardless of their three-dimensional shape) of up to about 10 nanometers (nm). In some cases, the solute precipitates can have an ECD of from about 5 nm to about 10 nm (e.g., about 5 nm, about 6 nm, about 7 nm, about 8 nm, about 9 nm, or about 10 nm). Such precipitates can be too large to support precipitation hardening, thus providing metallurgically stable rolled aluminum alloy products.

Additionally, the rolled aluminum alloy products in the T7 temper can be resistant to corrosion due to the solute precipitation at the grain boundaries. In some aspects, the rolled aluminum alloy products in the T7 temper demonstrate favorable characteristics when subjected to various downstream processing methods. For example, the T7 temper rolled aluminum alloy products are amenable to various types of joining, such as self-piercing riveting, welding (including resistive spot welding, metal inert gas welding, tungsten inert gas welding, shielded metal arc welding, and friction stir welding), and adhesive bonding. In some non-limiting examples, the rolled aluminum alloy products in T7 temper exhibit a favorable paint bake response (e.g., strengthening after heat treating to cure a coating).

The rolled aluminum alloy products in the T7 temper prepared according to the methods described herein exhibit desired elongation properties. For example, the rolled aluminum alloy products prepared and processed according to the methods described herein can achieve a uniform elongation of at least about 6% (e.g., from about 6.5% to about 12%, from about 7% to about 11%, or from about 7.5% to about 10%). In some cases, the uniform elongation can be about 6%, about 6.1%, about 6.2%, about 6.3%, about 6.4%, about 6.5%, about 6.6%, about 6.7%, about 6.8%, about 6.9%, about 7%, about 7.1%, about 7.2%, about 7.3%, about 7.4%, about 7.5%, about 7.6%, about 7.7%, about 7.8%, about 7.9%, about 8%, about 8.1%, about 8.2%, about 8.3%, about 8.4%, about 8.5%, about 8.6%, about 8.7%, about 8.8%, about 8.9%, about 9%, about 9.1%, about 9.2%, about 9.3%, about 9.4%, about 9.5%, about 9.6%, about 9.7%, about 9.8%, about 9.9%, about 10%, about 10.1%, about 10.2%, about 10.3%, about 10.4%, about 10.5%, about 10.6%, about 10.7%, about 10.8%, about 10.9%, about 11%, about 11.1%, about 11.2%, about 11.3%, about 11.4%, about 11.5%, about 11.6%, about 11.7%, about 11.8%, about 11.9%, or about 12%.

In some examples, the rolled aluminum alloy products prepared and processed according to the methods described herein can achieve a total elongation of at least about 9% (e.g., from about 9% to about 15% or from about 9.5% to about 14%). In some cases, the total elongation can be about 9%, about 9.1%, about 9.2%, about 9.3%, about 9.4%, about 9.5%, about 9.6%, about 9.7%, about 9.8%, about 9.9%, about 10%, about 10.1%, about 10.2%, about 10.3%, about 10.4%, about 10.5%, about 10.6%, about 10.7%, about 10.8%, about 10.9%, about 11%, about 11.1%, about 11.2%, about 11.3%, about 11.4%, about 11.5%, about 11.6%, about 11.7%, about 11.8%, about 11.9%, about 12%, about 12.1%, about 12.2%, about 12.3%, about 12.4%, about 12.5%, about 12.6%, about 12.7%, about 12.8%, about 12.9%, about 13%, about 13.1%, about 13.2%, about 13.3%, about 13.4%, about 13.5%, about 13.6%, about 13.7%, about 13.8%, about 13.9%, about 14%, about 14.1%, about 14.2%, about 14.3%, about 14.4%, about 14.5%, about 14.6%, about 14.7%, about 14.8%, about 14.9%, or about 15%.

Figure 2:
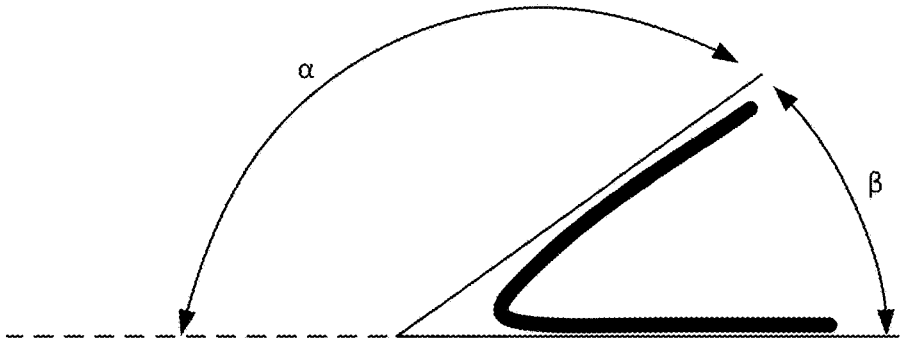
FIG. 2 is a schematic depicting the external three-point bend α-angle and the internal three-point bend β-angle measured in a three-point bend test according to the methods described herein.

The rolled aluminum alloy products in the T7 temper prepared according to the methods described herein exhibit desired bendability properties as measured by a three-point bend test according to ISO 7438 (general bending standard) and VDA 238-100. FIG. 2 depicts the external α-angle and internal β-angle measured during the three-point bend test. For example, the rolled aluminum alloy products prepared and processed according to the methods described herein can achieve a three-point bend β-angle of at least about 132.5° (e.g., about 132.5°, about 133°, about 133.5°, about 134°, about 134.5°, about 135°, about 135.5°, about 136°, about 136.5°, about 137°, about 137.5°, about 138°, about 138.5°, about 139°, about 139.5°, about 140°, about 140.5°, about 141°, about 141.5°, about 142°, about 142.5°, about 143°, about 143.5°, about 144°, about 144.5°, about 145°, about 145.5°, about 146°, about 146.5°, about 147°, about 147.5°, about 148°, about 148.5°, about 149°, about 149.5°, or about 150°).

The methods described herein improve the elongation of the rolled aluminum alloy products while preserving the strength properties. For example, the rolled aluminum alloy products prepared according to the methods described herein can have a yield strength of at least about 450 MPa (e.g., from about 450 MPa to about 600 MPa or from about 475 MPa to about 575 MPa). In some examples, the yield strength can be about 450 MPa, about 460 MPa, about 470 MPa, about 480 MPa, about 490 MPa, about 500 MPa, about 510 MPa, about 520 MPa, about 530 MPa, about 540 MPa, about 550 MPa, about 560 MPa, about 570 MPa, about 580 MPa, about 590 MPa, about 600 MPa, or anywhere in between.

The rolled aluminum alloy products prepared according to the methods described herein can have an ultimate tensile strength of at least about 450 MPa (e.g., from about 450 MPa to about 650 MPa or from about 475 MPa to about 600 MPa). In some examples, the ultimate tensile strength can be about 450 MPa, about 460 MPa, about 470 MPa, about 480 MPa, about 490 MPa, about 500 MPa, about 510 MPa, about 520 MPa, about 530 MPa, about 540 MPa, about 550 MPa, about 560 MPa, about 570 MPa, about 580 MPa, about 590 MPa, about 600 MPa, about 610 MPa, about 620 MPa, about 630 MPa, about 640 MPa, about 650 MPa, or anywhere in between.

The methods employed herein can alter the metallurgical state of the rolled aluminum alloy product within a range suitable for manufacturing practices. The metallurgical state can be characterized by electrical conductivity, measured according to the standard protocols. ASTM E1004, entitled "Standard Test Method for Determining Electrical Conductivity Using the Electromagnetic (Eddy-Current) Method," specifies the relevant testing procedures for metallic materials. The rolled aluminum alloy products prepared according to the methods described herein can have an electrical conductivity of up to about 40% International Annealed Copper Standard (% IACS) (e.g., from about 30% IACS to about 40% IACS, from about 30.5% IACS to about 39% IACS, from about 31% IACS to about 38.5% IACS, or from about 31.5% IACS to about 38% IACS). For example, in some cases, the rolled aluminum alloy products prepared and processed according to the methods described herein can have an electrical conductivity of about 30% IACS, about 30.5% IACS, about 31% IACS, about 31.5% IACS, about 32% IACS, about 32.5% IACS, about 33% IACS, about 33.5% IACS, about 34% IACS, about 34.5% IACS, about 35% IACS, about 35.5% IACS, about 36% IACS, about 36.5% IACS, about 37% IACS, about 37.5% IACS, about 38% IACS, about 38.5% IACS, about 39% IACS, about 39.5% IACS, or about 40% IACS.

Methods of Using

The products and methods described herein can be used in automotive and/or transportation applications, including motor vehicle, aircraft, and railway applications, or any other desired application. In some examples, the products and methods can be used to prepare motor vehicle body part products, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The rolled aluminum alloy products and methods described herein can also be used in aircraft or railway vehicle applications, to prepare, for example, external and internal panels.

The products and methods described herein can also be used in electronics applications, to prepare, for example, external and internal encasements. For example, the products and methods described herein can also be used to prepare housings for electronic devices, including mobile phones and tablet computers. In some examples, the products can be used to prepare housings for the outer casing of mobile phones (e.g., smart phones) and tablet bottom chassis.

In certain aspects, the products and methods can be used to prepare aerospace vehicle body part products. For example, the disclosed products and methods can be used to prepare airplane body parts, such as skin alloys.

In certain aspects, the products described herein exhibit surprising characteristics during downstream processing (e.g., post-processing by an end user and/or original equipment manufacturer). The products described herein can exhibit an improved corrosion response in a stress corrosion cracking test, improved bendability (e.g., providing a 7xxx series rolled aluminum alloy amenable to self-piercing riveting (SPR)), and an improved crash and/or crush response. Further, the products described herein do not adversely impact the artificial aging response during the paint baking (PB) process. Additionally, the products described herein do not exhibit a loss of strength resulting from the downstream processing.

Illustrations

Illustration 1 is a method of processing a rolled aluminum alloy product, comprising: solutionizing a rolled aluminum alloy product at a solutionizing temperature of at least about 400° C.; quenching the rolled aluminum alloy product to produce a W temper rolled aluminum alloy product; naturally aging the W temper rolled aluminum alloy product to produce an intermediate aged rolled aluminum alloy product; and artificially aging the intermediate aged rolled aluminum alloy product for a period of time up to about 8 hours.

Illustration 2 is the method of any preceding or subsequent illustration, wherein the solutionizing temperature is from at least about 400° C. to about 500° C.

Illustration 3 is the method of any preceding or subsequent illustration, further comprising deforming the rolled aluminum alloy product at a temperature of from about 125° C. to about 500° C.

Illustration 4 is the method of any preceding or subsequent illustration, wherein quenching the rolled aluminum alloy product comprises cooling the rolled aluminum alloy product at a rate of from about 5° C./second to about 1000° C./second.

Illustration 5 is the method of any preceding or subsequent illustration, wherein quenching the rolled aluminum alloy product is performed after solutionizing the rolled aluminum alloy product.

Illustration 6 is the method of any preceding or subsequent illustration, wherein quenching the rolled aluminum alloy product is performed after deforming the rolled aluminum alloy product.

Illustration 7 is the method of any preceding or subsequent illustration, wherein naturally aging the W temper rolled aluminum alloy product comprises aging the W temper rolled aluminum alloy product at room temperature for up to about 12 months.

Illustration 8 is the method of any preceding or subsequent illustration, wherein naturally aging the W temper rolled aluminum alloy product comprises aging the W temper rolled aluminum alloy product at room temperature for up to about 6 months.

Illustration 9 is the method of any preceding or subsequent illustration, wherein artificially aging the intermediate aged rolled aluminum alloy product comprises a single step aging procedure.

Illustration 10 is the method of any preceding or subsequent illustration, wherein the single step aging procedure comprises heating the intermediate aged rolled aluminum alloy product to a temperature of at least about 140° C. and maintaining this temperature for up to about 8 hours.

Illustration 11 is the method of any preceding or subsequent illustration, wherein artificially aging the intermediate aged rolled aluminum alloy product comprises a multiple-step aging procedure.

Illustration 12 is the method of any preceding or subsequent illustration, wherein the multiple-step aging procedure comprises at least a first aging step and at least a second aging step.

Illustration 13 is the method of any preceding or subsequent illustration, wherein the first aging step comprises heating the intermediate aged rolled aluminum alloy product to a first aging temperature of from about 90° C. to about 120° C. and maintaining the first aging temperature for from about 0.5 hours up to about 2 hours.

Illustration 14 is the method of any preceding or subsequent illustration, wherein the second aging step comprises heating the intermediate aged rolled aluminum alloy product to a second aging temperature of from about 140° C. to about 220° C. and maintaining the second aging temperature for from about 0.5 hours up to about 7.5 hours.

Illustration 15 is the method of any preceding or subsequent illustration, wherein the first aging step comprises heating the intermediate aged rolled aluminum alloy product to a first aging temperature of from about 50° C. to about 90° C. and maintaining the first aging temperature for up to about 1 hour.

Illustration 16 is the method of any preceding or subsequent illustration, wherein the second aging step comprises heating the intermediate aged rolled aluminum alloy product to a second aging temperature of from about 160° C. to about 200° C. and maintaining the second aging temperature for up to about 1 hour.

Illustration 17 is the method of any preceding or subsequent illustration, wherein: the first aging step comprises heating the intermediate aged rolled aluminum alloy product to a first aging temperature of from about 90° C. to about 135° C. and maintaining the first aging temperature for a period of time; and the second aging step comprises heating the intermediate aged rolled aluminum alloy product to a second aging temperature of from about 140° C. to about 220° C. and maintaining the second aging temperature for a period of time, wherein a total aging time of the first aging step and the second aging step is greater than 5 hours.

Illustration 18 is the method of any preceding or subsequent illustration, wherein the rolled aluminum alloy product comprises a heat treatable rolled aluminum alloy product.

Illustration 19 is the method of any preceding or subsequent illustration, wherein the rolled aluminum alloy product is prepared from a monolithic alloy.

Illustration 20 is the method of any preceding or subsequent illustration, wherein the rolled aluminum alloy product is prepared from a clad rolled aluminum alloy product having a core layer and at least one clad layer.

Illustration 21 is a method of processing a rolled aluminum alloy product according to any preceding or subsequent illustration, comprising: deforming a rolled aluminum alloy product at a temperature of from about 125° C. to about 500° C.; quenching the rolled aluminum alloy product to produce a W temper rolled aluminum alloy product; naturally aging the W temper rolled aluminum alloy product to produce an intermediate aged rolled aluminum alloy product; and artificially aging the intermediate aged rolled aluminum alloy product for a period of time up to about 8 hours.

Illustration 22 is a product prepared according to a method of any preceding or subsequent illustration.

Illustration 23 is the product of any preceding or subsequent illustration, wherein the product is provided in a T7 temper.

Illustration 24 is the product of any preceding or subsequent illustration, wherein an equivalent circular diameter of intergranular precipitates comprises up to about 10 nanometers.

Illustration 25 is the product of any preceding or subsequent illustration, wherein the equivalent circular diameter of intergranular precipitates comprises from about 5 nanometers to about 10 nanometers.

Illustration 26 is the product of any preceding or subsequent illustration, wherein the product comprises an electrical conductivity of up to about 40% IACS.

Illustration 27 is the product of any preceding or subsequent illustration, wherein the product comprises a yield strength of at least about 450 MPa.

Illustration 28 is the product of any preceding or subsequent illustration, wherein the product comprises a uniform elongation of at least about 6%.

Illustration 29 is the product of any preceding or subsequent illustration, wherein the product comprises a three-point bend β-angle of at least 132.5°.

Illustration 30 is the product of any preceding or subsequent illustration, wherein the product is an automotive body part, an aerospace body part, a marine body part, or an electronics device housing.

Illustration 31 is the product of any preceding or subsequent illustration, wherein the product is an automotive body part and the automotive body part is a bumper, a side beam, a roof beam, a cross beam, a pillar reinforcement, an inner panel, an outer panel, a side panel, an inner hood, an outer hood, or a trunk lid panel.

Illustration 32 is the product of any preceding or subsequent illustration, wherein the product exhibits a three-point bend β-angle sufficient for self-piercing riveting.

Illustration 33 is the product of any preceding illustration, wherein the product exhibits an electrical conductivity sufficient to indicate resistance to stress corrosion cracking.

The following examples will serve to further illustrate the present invention without, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

Example 1

Effect of Accelerated Aging on Mechanical Properties

Two 7xxx series rolled aluminum alloy products, Alloy 1 (an AA7075 aluminum alloy) and Alloy 2 (a 7xxx aluminum alloy comprising 9.16 wt. % Zn, 1.18 wt. % Cu, 2.29 wt. % Mg, 0.23 wt. % Fe, 0.1 wt. % Si, 0.11 wt. % Zr, 0.042 wt. % Mn, 0.04 wt. % Cr, 0.01 wt. %, Ti, up to 0.15 wt. % impurities, and the remainder Al), were prepared by identical methods for mechanical testing. Specifically, the alloys were solutionized at a temperature of 480° C. and maintained at this temperature for 5 minutes. The alloys were subsequently naturally aged for 3 days. The alloys were then subjected to the accelerated aging process including a two-step accelerated aging process according to the parameters listed under the heading "Aging Conditions" in Table 1 and Table 2. Additionally, two samples from each of Alloy 1 and Alloy 2 were subjected to comparative artificial aging processes to age the Alloys to a T73 temper (referred to as "107° C./6 hr-160° C./24 hr" in Table 1 and Table 2) and a T6 temper (referred to as "125° C./24 hr" in Table 1 and Table 2).

The mechanical properties of the alloy products were evaluated before and after the products were subjected to a paint bake process after the accelerated aging process. The paint bake process included a step of heating the rolled aluminum alloy product to 180° C. and maintaining this temperature for 30 minutes. Tensile testing of samples was conducted according to ASTM E8/EM8 entitled "Standard Test Methods for Tension Testing of Metallic Materials." Specifically, the yield strength ("YS"), ultimate tensile strength ("UTS"), uniform elongation ("UE"), and total elongation ("TE") were measured. Bendability of the alloy products was determined by subjecting the alloy products to a three-point bend test measuring the internal three-point bend β-angle according to the VDA 238-100 Tight Radius Bending Test. Electrical conductivity ("EC") testing was conducted according to ASTM E1004, entitled "Standard Test Method for Determining Electrical Conductivity Using the Electromagnetic (Eddy-Current) Method." The results for Alloy 1 are shown below in Table 1.

TABLE 1

| Aging Conditions | Paint Bake Timing | YS (MPa) | EC (% IACS) | Three-Point Bend β-angle (°) | UTS (MPa) | UE (%) | TE (%) |
|---|---|---|---|---|---|---|---|
| 110° C./1 hr and then 160° C./6 hr | Before | 509 | 33.425 | 137.0 | 563 | 9.3 | 12.1 |
| 110° C./1 hr and then 160° C./6 hr | After | 500 | 33.715 | | 556 | 9.3 | 12.7 |
| 110° C./1 hr and then 160° C./3 hr | Before | 502 | 32.775 | 134.6 | 561 | 10.0 | 13.2 |
| 110° C./1 hr and then 160° C./3 hr | After | 495 | 33.185 | | 553 | 9.3 | 12.2 |
| 110° C./1 hr and then 160° C./1 hr | Before | 493 | 31.775 | 132.5 | 557 | 11.2 | 14.1 |
| 110° C./1 hr and then 160° C./1 hr | After | 495 | 32.85 | | 554 | 9.9 | 12.8 |
| 110° C./1 hr and then 180° C./2 hr | Before | 506 | 35.13 | 133.3 | 561 | 8.7 | 11.2 |
| 110° C./1 hr and then 180° C./2 hr | After | 491 | 35.455 | | 546 | 7.9 | 9.9 |
| 110° C./1 hr and then 180° C./1 hr | Before | 487 | 34.305 | 134.2 | 548 | 8.9 | 11.3 |
| 110° C./1 hr and then 180° C./1 hr | After | 487 | 35.03 | | 546 | 8.8 | 11.3 |
| 110° C./1 hr and then 200° C./1 hr | Before | 455 | 37.62 | 135.0 | 520 | 8.6 | 11.7 |
| 110° C./1 hr and then 200° C./1 hr | After | 465 | 37.865 | | 525 | 8.3 | 10.9 |
| 125° C./1 hr and then 160° C./6 hr | Before | 499 | 33.6 | 133.5 | 555 | 9.2 | 12.3 |
| 125° C./1 hr and then 160° C./6 hr | After | 479 | 33.915 | | 543 | 8.5 | 10.9 |
| 107° C./6 hr and then 160° C./24 hr | Before | 484 | 36.95 | 135.4 | 540 | 8.1 | 11.0 |
| 107° C./6 hr and then 160° C./24 hr | After | 481 | 36.935 | | 537 | 8.5 | 11.4 |
| 125° C./24 hr | Before | 480 | 32.155 | 133.2 | 544 | 9.0 | 11.9 |
| 125° C./24 hr | After | 476 | 32.88 | | 542 | 9.8 | 12.5 |

The mechanical property test results for Alloy 2 are shown below in Table 2.

TABLE 2

| Aging Conditions | Paint Bake Timing | Yield Strength (MPa) | EC (% IACS) | Three-Point Bend β-angle (°) | UTS (MPa) | UE (%) | TE (%) |
|---|---|---|---|---|---|---|---|
| 100° C./1 hr and then 160° C./6 hr | Before | 560 | 33.92 | 141.7 | 586 | 6.7 | 9.8 |
| 100° C./1 hr and then 160° C./6 hr | After | 542 | 34.865 | | 573 | 7.0 | 10.1 |
| 100° C./1 hr and then 160° C./3 hr | Before | 585 | 33.165 | 143.9 | 603 | 6.3 | 10.5 |
| 100° C./1 hr and then 160° C./3 hr | After | 557 | 34.5 | | 583 | 6.8 | 10.8 |
| 100° C./1 hr and then 160° C./1 hr | Before | 584 | 30.42 | 140.9 | 610 | 7.7 | 11.5 |
| 100° C./1 hr and then 160° C./1 hr | After | 574 | 32.865 | | 594 | 6.6 | 10.2 |
| 100° C./1 hr and then 180° C./2 hr | Before | 532 | 35.64 | 137.8 | 565 | 7.5 | 11.6 |
| 100° C./1 hr and then 180° C./2 hr | After | 510 | 36.425 | | 550 | 7.1 | 10.5 |
| 100° C./1 hr and then 180° C./1 hr | Before | 563 | 34.46 | 138.8 | 587 | 6.8 | 10.8 |
| 100° C./1 hr and then 180° C./1 hr | After | 544 | 35.18 | | 573 | 6.9 | 10.4 |
| 100° C./1 hr and then 200° C./1 hr | Before | 449 | 37.64 | 134.5 | 511 | 8.0 | 11.6 |
| 100° C./1 hr and then 200° C./1 hr | After | 444 | 38.07 | | 507 | 7.8 | 10.9 |
| 125° C./1 hr and then 160° C./6 hr | Before | 563 | 33.55 | 140.2 | 589 | 6.8 | 10.4 |
| 125° C./1 hr and then 160° C./6 hr | After | 535 | 34.895 | | 568 | 6.8 | 9.5 |
| 107° C./6 hr and then 160° C./24 hr | Before | 479 | 37.66 | 136.2 | 530 | 7.6 | 12.3 |
| 107° C./6 hr and then 160° C./24 hr | After | 466 | 37.885 | | 521 | 7.7 | 11.4 |
| 125° C./24 hr | Before | 600 | 30.17 | 146.5 | 623 | 7.4 | 12.2 |
| 125° C./24 hr | After | 562 | 33.11 | | 586 | 6.4 | 9.5 |

Alloy 1 and Alloy 2, processed according to the accelerated aging process described herein to a T7 temper, were able to achieve yield strengths ("YS") and ultimate tensile strengths ("UTS") comparable to and greater than Alloy 1 and Alloy 2 in T6 temper (referred to as "125° C./24 hr" in Tables 1 and 2). Also, Alloy 1 and Alloy 2 in the T7 temper demonstrated higher three-point bend β-angles than Alloy 1 and Alloy 2 in T6 temper, indicating a higher formability. Alloys 1 and 2 processed using the accelerated aging process described herein displayed electrical conductivities ("EC") comparable to Alloy 1 and Alloy 2 in T6 temper.

As shown in Table 1 and Table 2, Alloys 1 and 2 processed according to the accelerated aging process described herein maintained high strength values (including yield strength and ultimate tensile strength) before and after the paint baking process. However, Alloy 2 in T6 temper (referred to as "125° C./24 hr" in Table 2) demonstrated a loss of yield strength and a loss of ultimate tensile strength of about 40 MPa each after paint baking.

Figure 3:
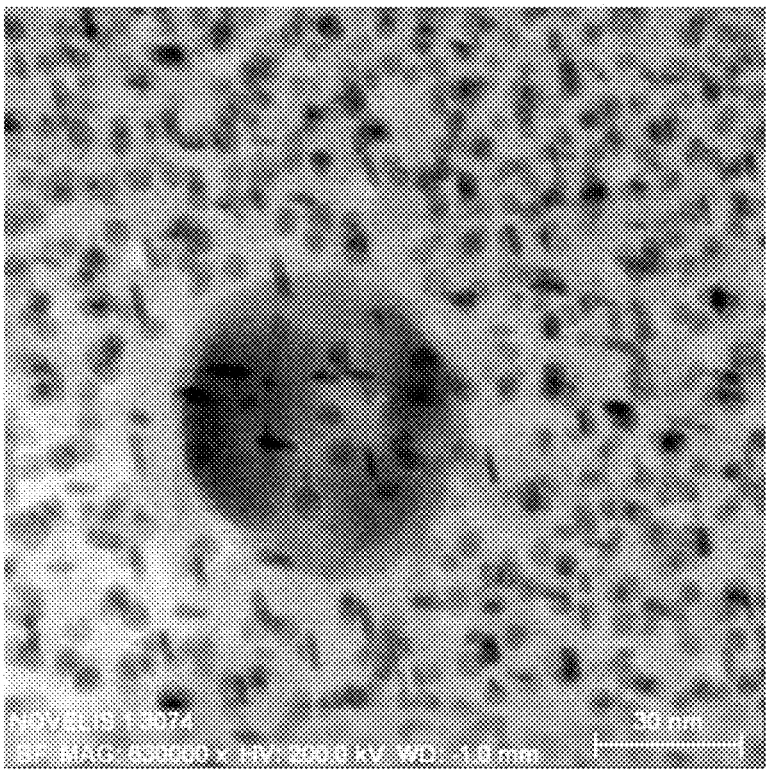
FIG. 3 is a scanning transmission electron microscope (STEM) micrograph depicting a microstructure of a heat treatable rolled aluminum alloy product prepared and processed according to the methods described herein.
Figure 4:
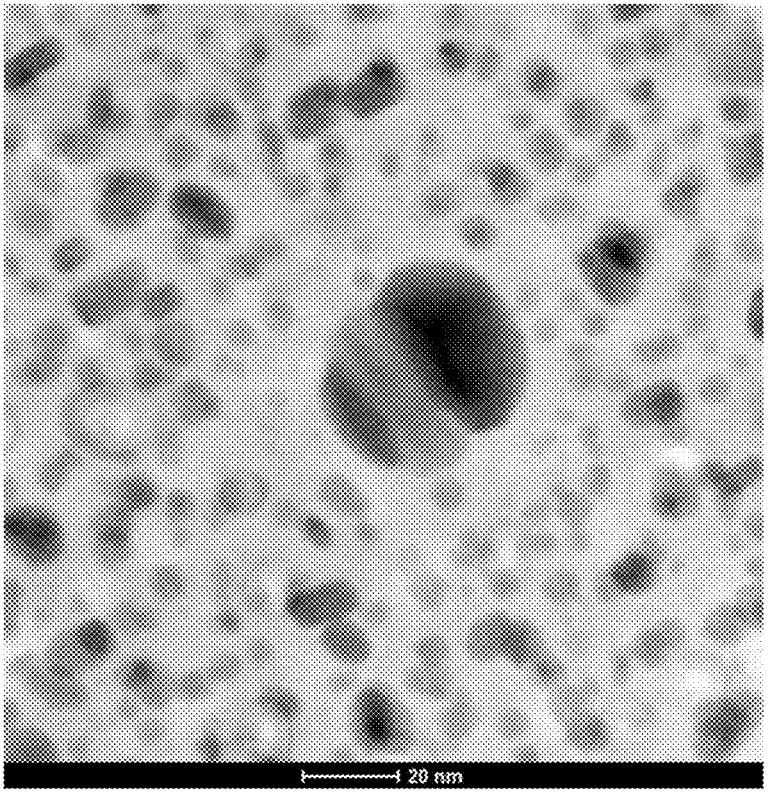
FIG. 4 is a STEM micrograph depicting an overaged microstructure of a heat treatable rolled aluminum alloy product prepared and processed according to the methods described herein.

The microstructures of the alloy products were evaluated before and after the products were subjected to a paint bake process after the accelerated aging process described above. FIG. 3 shows the microstructure of Alloy 1 in a T6 temper. FIG. 4 shows the microstructure of Alloy 1 in the T7 temper. As shown in FIG. 4, Alloy 1 exhibited intergranular particles having a larger equivalent circular diameter after the paint bake process when compared to Alloy 1 before the paint bake process as shown in FIG. 3. The larger intergranular particles indicated that Alloy 1 was overaged after the paint bake process, thus Alloy 1 achieved a T7 temper after the paint bake process.

Example 2

Exemplary Artificial Aging Processes

Table 3 below provides exemplary artificial aging processes as described herein.

TABLE 3

| First Aging Step | | Second Aging Step | | Total |
|---|---|---|---|---|
| Temperature (° C.) | Time | Temperature (° C.) | Time | Aging Time Time |
| 110 | 1 hour | 160 | 6 hours | 7 hours |
| 110 | 1 hour | 160 | 3 hours | 4 hours |
| 110 | 1 hour | 160 | 1 hour | 2 hours |
| 110 | 1 hour | 180 | 2 hours | 3 hours |
| 110 | 1 hour | 180 | 1 hour | 2 hours |
| 110 | 1 hour | 200 | 1 hour | 2 hours |
| 125 | 1 hour | 160 | 6 hours | 7 hours |
| 50 | 30 minutes | 190 | 15 minutes | 45 minutes |
| 70 | 15 minutes | 190 | 15 minutes | 30 minutes |
| 70 | 15 minutes | 170 | 15 minutes | 30 minutes |
| 70 | 30 minutes | 170 | 15 minutes | 45 minutes |
| 90 | 30 minutes | 190 | 15 minutes | 45 minutes |

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A method of processing a rolled 7xxx series aluminum alloy product, comprising:

solutionizing a rolled 7xxx series aluminum alloy product at a solutionizing temperature of at least 400° C.;

quenching the rolled 7xxx series aluminum alloy product to produce a W temper rolled 7xxx series aluminum alloy product;

naturally aging the W temper rolled aluminum alloy product to produce an intermediate aged rolled 7xxx series aluminum alloy product for at least one day; and artificially aging the intermediate aged rolled 7xxx series aluminum alloy product for a period of time up to 7 hours.

2. The method of claim 1, wherein the solutionizing temperature is from at least 400° C. to 500° C.

3. The method of claim 1, further comprising deforming the rolled aluminum alloy product at a temperature of from about 125° C. to about 500° C.

4. The method of claim 1, wherein quenching the rolled aluminum alloy product comprises cooling the rolled aluminum alloy product at a rate of from 5° C./second to 1000° C./second.

5. The method of claim 3, wherein quenching the rolled aluminum alloy product is performed after deforming the rolled aluminum alloy product.

6. The method of claim 1, wherein naturally aging the W temper rolled aluminum alloy product comprises aging the W temper rolled aluminum alloy product at room temperature for up to 12 months.

7. The method of claim 1, wherein artificially aging the intermediate aged rolled aluminum alloy product comprises a single step aging procedure.

8. The method of claim 1, wherein artificially aging the intermediate aged rolled aluminum alloy product comprises a multiple-step aging procedure.

9. The method of claim 8, wherein the multiple-step aging procedure comprises at least a first aging step and at least a second aging step.

10. A method of processing a rolled 7xxx series aluminum alloy product, comprising:

solutionizing a rolled 7xxx series aluminum alloy product at a solutionizing temperature of at least 400° C.;

quenching the rolled 7xxx series aluminum alloy product to produce a W temper rolled 7xxx series aluminum alloy product;

naturally aging the W temper rolled aluminum alloy product to produce an intermediate aged rolled 7xxx series aluminum alloy product for at least one day; and artificially aging the intermediate aged rolled 7xxx series aluminum alloy product for a period of time up to 7 hours through at least two aging steps; wherein:

the first aging step comprises heating the intermediate aged rolled aluminum alloy product to a first aging temperature of from 90° C. to 135° C. and maintaining the first aging temperature for a period of time; and the second aging step comprises heating the intermediate aged rolled aluminum alloy product to a second aging temperature of from 140° C. to 220° C. and maintaining the second aging temperature for a period of time, wherein a total aging time of the first aging step and the second aging step is greater than 5 hours.

11. The method of claim 1, wherein the rolled aluminum alloy product is prepared from a monolithic alloy, or wherein the rolled aluminum alloy product is prepared from a clad rolled aluminum alloy product having a core layer and at least one clad layer.

* * * * *